US006625411B2

(12) United States Patent
Yoda et al.

(10) Patent No.: US 6,625,411 B2
(45) Date of Patent: Sep. 23, 2003

(54) COLOR IMAGE FORMING APPARATUS

(75) Inventors: Kaneo Yoda, Nagano (JP); Nobumasa Abe, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/092,723

(22) Filed: Mar. 8, 2002

(65) Prior Publication Data

US 2002/0141782 A1 Oct. 3, 2002

(30) Foreign Application Priority Data

Mar. 9, 2001 (JP) ..... P2001-067576
Apr. 5, 2001 (JP) ..... P2001-106783

(51) Int. Cl.[7] ..... G03G 15/01; G03G 15/16

(52) U.S. Cl. ..... 399/167; 399/299; 399/301; 399/302

(58) Field of Search ..... 399/75, 167, 298, 399/299, 301, 302, 303, 313

(56) References Cited

U.S. PATENT DOCUMENTS 5,970,286 A * 10/1999 Numazu et al. ..... 399/167
5,987,291 A * 11/1999 Masuda ..... 399/302
6,453,139 B2 * 9/2002 Sasame et al. ..... 399/167
6,463,247 B1 * 10/2002 Kawano et al. ..... 399/299

FOREIGN PATENT DOCUMENTS

JP 4-324881 A 11/1992
JP 09-179372 * 7/1997
JP 2686267 B2 8/1997
JP 11-65222 A 3/1999
JP 2002-014511 * 1/2002

* cited by examiner

*Primary Examiner*—Sophia S. Chen
(74) *Attorney, Agent, or Firm*—Sughrue Mion, PLLC

(57) ABSTRACT

In a color image forming apparatus, a looped belt member is stretched and circulated by at least a drive roller and a driven roller so as to have a tensed side and a slack side. Each of plural image supporting members supports a single color toner image thereon, and abuts onto the tensed side of the belt member to define a transferring position at which the toner image is transferred onto either the belt member or a recording medium held by the belt member, while being rotated. A circumferential velocity of each image supporting member is determined so as to be lower than a circulation velocity of the belt member. Further, a circumferential velocity of an image supporting member which is further from the driving roller may be lower than a circumferential velocity of an image supporting member which is closer to the driving roller.

18 Claims, 6 Drawing Sheets

COLOR IMAGE FORMING APPARATUS

BACKGROUND OF THE INVENTION

The present invention relates to a color image forming apparatus such as a color printer, a color copier, or a color facsimile using electrophotography for forming a color image. More particularly, the invention relates to a color image forming apparatus in which a plurality of toner images respectively formed by a plurality of single-color toner image formers are sequentially transferred on a transferring member or a recording medium held by the transferring member.

In general, an image forming apparatus and in particular, a tandem image forming apparatus using electrophotography has a photoconductor as an image supporting member having a photosensitive layer on the outer peripheral surface, a charger for uniformly charging the outer peripheral surface of the photoconductor, an exposing member for selectively exposing the outer peripheral surface charged uniformly by the charger for forming an electrostatic latent image thereon, and a developer for providing toner as a developing powder to the electrostatic latent image formed by the exposing member for providing a visible image (toner image).

Two types of tandem image forming apparatuses for forming a color image are known. In one type, a plurality of (for example, four) image supporting members are brought into contact with an intermediate transferring member such as a transferring belt or the like so that toner images on the image supporting members are sequentially transferred to the intermediate transferring member so as to superpose the toner images of a plurality of colors (for example, yellow, cyan, magenta, and black) thereon to provide a color image. In the other type, a recording medium, such as paper, is held and transported on a belt member, a drum member or the like, and toner images on a plurality of image supporting members are sequentially transferred to the recording medium so as to superpose the multiple-color toner images thereon to provide a color image.

In order to realize a good transfer state of toner images (therefore realizing a fine image) in the color image forming apparatus as described above, it is desirable that the circumferential velocity of the image supporting member and that of the transferring member be completely matched with each other. More practically, however, manufacturing errors and varying tolerances are usually introduced into the image supporting member, the transferring member, or the parts making up their driver units at the manufacturing stage. Thus, it is practically impossible to completely match the circumferential velocity of the image supporting member and that of the transferring member.

If the difference between the circumferential velocity of the image supporting member and that of the transferring member varies, for example, if the circumferential velocity of the image supporting member is higher than that of the transferring member at one point in time and the former becomes lower than the latter at another point in time, the transfer state becomes remarkably unstable and a fine image cannot be provided. Particularly, to superpose multiple-color toner images on each other for providing a color image, a color-to-color shift occurs and the image quality is remarkably degraded.

To prevent color shift from occurring, there is proposed a color image forming apparatus wherein a velocity of the transferring member Vt is faster than the circumferential velocity of each image supporting member Vd (Vt>Td) in Japanese Patent Publication No. 11-65222A.

As shown in FIG. 5, this color image forming apparatus comprises a conveyor belt 3 placed on a drive roller 1 and a driven roller 2. The conveyor belt 3 is circulated by the drive roller 1 and the driven roller 2, and holds and transports a recording medium P such as paper. Four single-color toner image formers 5, each having an image supporting member 4, are brought into contact with the conveyor belt 3 and sequentially transfer toner images on the plurality of image supporting members 4 to the recording medium P held on the conveyor belt 3.

Here, the velocity of the conveyor belt 3 is faster than the circumferential velocity of each of the image supporting members 4, that is, Vt>Vd.

According to the above configuration, each image supporting member 4 acts on the conveyor belt 3 as a brake. Thus, the tensed state of the conveyor belt 3 becomes stable between the drive roller 1 and the image supporting member 4 adjacent to the drive roller 1, but the image supporting members 4 are set to the same circumferential velocity Vd and the tensed state of the conveyor belt 3 becomes unstable between the image supporting members 4.

Therefore, the state of the transferring point from each image supporting member 4 to the recording medium P held on the conveyor belt 3 also becomes unstable and consequently, a good color image is not always provided.

Further, this publication does not describe any drive structures of the image supporting members and the conveyor belt as the transferring member.

Another way of trying to prevent color shift is disclosed in Japanese Patent Publication No. 4-324881A. This publication discloses an image forming apparatus wherein the velocity of an image supporting member is always higher than that of transferring member.

In FIG. 6, numeral 12 denotes an intermediate transferring drum, and four different-color photoconductive drums 11 (Y, M, C, and K) are brought into contact with the intermediate transferring drum 12. A yellow toner image provided by the photoconductive drum 11Y, a magenta toner image provided by the photoconductive drum 11M, a cyan toner image provided by the photoconductive drum 11C, and a black toner image provided by the photoconductive drum 11K are sequentially transferred to the intermediate transferring drum 12 to form a full-color toner image, which is then transferred to a recording medium P.

The intermediate transferring drum 12 is driven by a driver unit 14 and the photoconductive drums 11 (Y, M, C, and K) are driven by driver units 13 (Y, M, C, and K). Each of the driver units 13 (Y, M, C, and K) is provided with a velocity converter 15 (Y, M, C, and K) composed of a motor and gears.

In the related art apparatus shown in FIG. 6, since the driver units of the image supporting members and the driver unit of the transferring member are driven by separate drive sources to set the velocity V (Y, M, C, K) of the image supporting member (photoconductive drum 11) higher than the velocity V1 of the transferring member (intermediate transferring drum 12), the driving structure becomes very complicated and the apparatus size is also increased.

Japanese Patent No. 2686267 discloses an image forming apparatus having a mechanism for transmitting a driving force from an image supporting member to a transferring roller so that the circumferential velocity of the transferring roller becomes higher than that of the image supporting member, but this document teaches an apparatus for forming a single-color image and does not consider any color shift problem involved in forming a full-color image.

SUMMARY OF THE INVENTION

It is therefore an object of the invention to provide a color image forming apparatus which stabilizes the state of transferred toner images from respective image supporting members to a transferring member at a transferring point for providing a fine image with no color shift using a simple driving mechanism.

In order to achieve the above object, according to the present invention, there is provided a color image forming apparatus, comprising:

a drive roller and a driven roller;

a looped belt member, stretched and circulated by at least the drive roller and the driven roller so as to have a tensed side and a slack side; and a plurality of image supporting members, each supporting a single color toner image thereon, and abutting onto the tensed side of the belt member to define a transferring position at which the toner image is transferred onto either the belt member or a recording medium held by the belt member, while being rotated, wherein:

a circumferential velocity of each image supporting member is determined so as to be lower than a circulation velocity of the belt member; and a circumferential velocity of an image supporting member which is further from the driving roller is lower than a circumferential velocity of an image supporting member which is closer to the driving roller.

In this configuration, since the image supporting member positioned upstream always acts as a brake with respect to a portion of the belt member situated between the adjacent image supporting members, the tensed state of the belt member becomes stable also between the respective image supporting members. Therefore, the condition of each transferring position becomes stable so that a good color image can be obtained.

Moreover, since the tensed state of the transferring belt becomes stable when the image forming apparatus is activated (when the image supporting members and the belt member are driven), an initial tension given to the transferring belt can be lessened. Therefore, if the image forming apparatus is not activated for a long time period, a considerably large tension does not act on the belt member. Consequently, creep deformation of the belt, which adversely affects image formation, is reduced.

In a preferred embodiment, the apparatus further comprises:

a first gear train, which rotates the image supporting members;

a second gear train, which rotates the drive roller to circulate the belt member, while being connected to the first gear train with no branch; and a single drive source, which drives the first gear train to thereby drive the second gear train.

In this configuration, backlash in the image supporting member drive gear train that might occur due to the fact that the circumferential velocity of the image supporting member is lower than the circulation velocity Vt of the belt member does not occur, so that good color superposing accuracy can be attained.

Also according to the invention, a surface hardness of the belt member may be greater than a surface hardness of the respective image supporting members. Alternatively, or in addition to this surface hardness relationship, a surface roughness of the belt member may be greater than a surface roughness of the respective image supporting members.

In addition, an abrasive may be applied on a surface of the belt member.

In any of the above configurations, whenever the surface of the image supporting member comes in contact with the belt member, because of the difference between the circulation velocity of the belt member and the circumferential velocity of the image supporting member, the surface of the image supporting member which is slightly cut is always refreshed. Therefore, filming is prevented allowing the image quality to be maintained.

Preferably, the color image forming apparatus further comprises a cleaning member which abuts against a part of the belt member which is wound on the driven roller, to remove toner remained on the belt member.

In this configuration, the stretched condition of the intermediate transfer belt becomes stable even at the initial stage of image formation.

Preferably, the color image forming apparatus further comprises a secondary transfer position, formed on a part of the belt member which is wound on the driven roller, at which the toner images transferred from the image supporting members are secondarily transferred to a recording medium. The recording medium passes through the secondary transfer position upward from a lower part of the apparatus.

In this configuration, it is not necessary to provide the individual transfer roller inside of the transfer belt as shown in FIG. 5, so that it is possible to downsize the stretching structure of the transfer belt, thereby reducing the size of the apparatus.

Here, it is preferable that the color image forming apparatus further comprises a fixing section at which the secondarily transferred toner image is fixed on the recording medium. The fixing section is placed above the plurality of image supporting members.

In this configuration, heat or water vapor generated from the fixing section can be prevented from invading into the image forming section, so that it is possible to prevent occurrence of an image failure caused by temperature fluctuation, a registration shift caused by thermal expansion, an image failure caused by dew condensation, sticking of the contact parts, or the like.

In another embodiment according to the present invention, there is provided a color image forming apparatus, comprising:

a transferring member;

a plurality of image supporting members, each supporting a single color toner image thereon, and abutting onto the transferring member to define a transferring position at which the toner image is transferred onto either the transferring member or a recording medium held by the transferring member, while being rotated;

a first gear train, which rotates the image supporting members;

a second gear train, which rotates the transferring member, while being connected to the first gear train with no branch; and a single drive source, which drives the first gear train to thereby drive the second gear train, wherein a circumferential velocity of each image supporting member is determined so as to be lower than a circulation velocity of the belt member.

In this configuration, since the circumferential velocity of the transferring member is lower than the circumferential velocity of each image supporting member, the variation in the difference between the circumferential velocity of the respective image supporting members and the circumferential velocity of the transferring member can be minimized. This makes it possible to stabilize the transferring condition of the toner image of each color from each of the image supporting members to the transferring member to provide a fine image.

Furthermore, since both of the first gear train and the second gear train are driven by the single drive source, the mechanical structure is remarkably simplified which allows for the apparatus size to be reduced.

Moreover, backlash in the first gear train does not occur even though the circumferential velocity of the transferring member is greater than the circumferential velocity of the respective image supporting members. Therefore, the above relationship between the rotation velocities can be reliably provided.

Particularly in the tandem-type color image forming apparatus, not only the driving mechanism for the plural image supporting members and the transferring member is remarkably simplified, but also a fine color image with no color shift can be reliably obtained.

In this embodiment, the surface hardness of the transferring member may also be greater than a surface hardness of the respective image supporting members. Alternatively, or in addition to this surface hardness relationship, a surface roughness of the belt member may be greater than a surface roughness of the respective image supporting members.

Furthermore, an abrasive may be applied on a surface of the transferring member.

In any of the above configurations, whenever the surface of the image supporting member comes in contact with the transferring member, because of the difference between the circumferential velocity of the transferring member and the circumferential velocity of the image supporting member, the surface of the image supporting member which is slightly cut is always refreshed. Therefore, the filming is prevented so that the image quality is maintained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there will be described one preferred embodiment of the invention.

Figure 1:
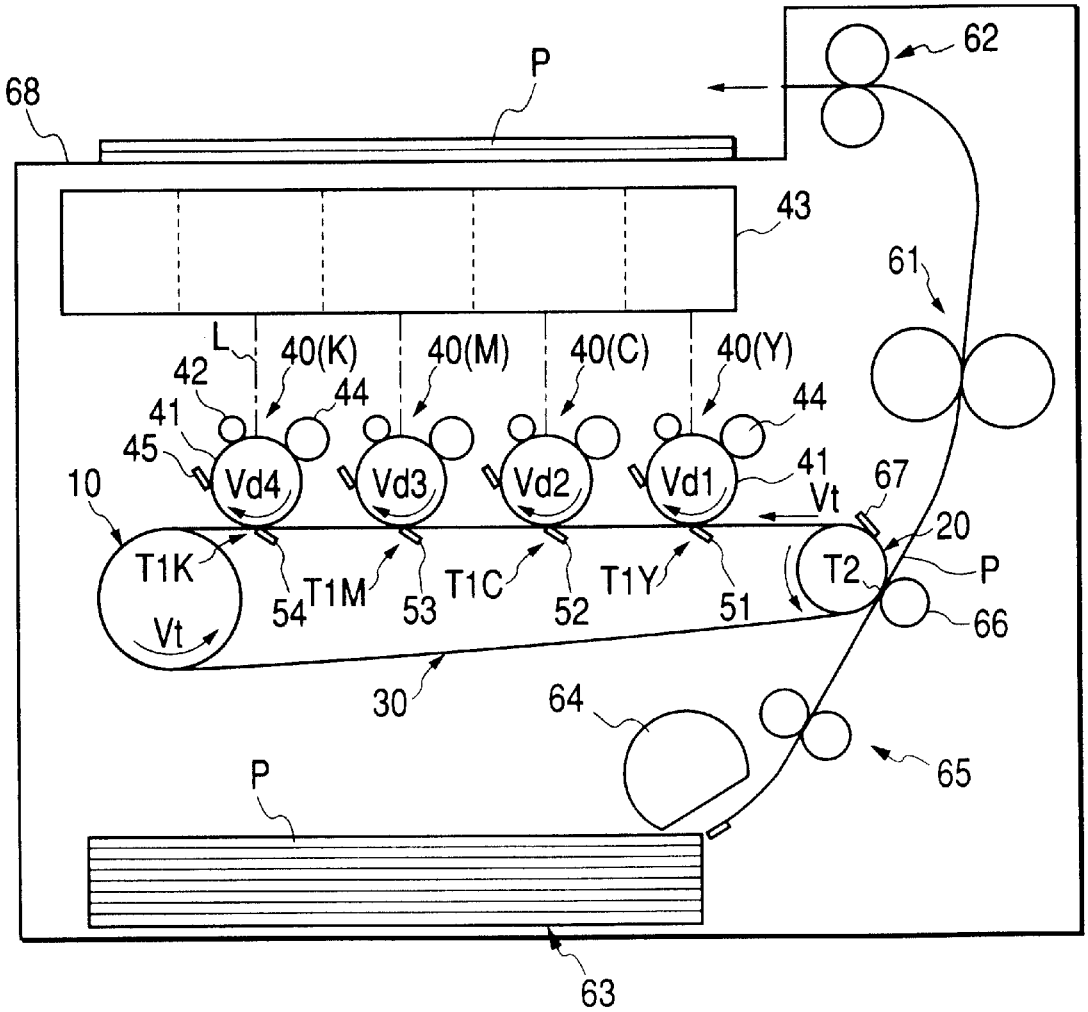
FIG. 1 is a schematic front view to show a color image forming apparatus according to a first embodiment of the invention.

As shown in FIG. 1, in a color image forming apparatus, an intermediate transferring belt 30 is wound on a drive roller 10 and a driven roller 20 and circulated in the arrow direction shown (counterclockwise). A plurality of (four) single-color toner image formers 40 (Y, C, M, and K) are brought into contact with the intermediate transferring belt 30, and color toner images provided by the plurality of single-color toner image formers 40 are sequentially transferred to the intermediate transferring belt 30 by separate transferring members 51, 52, 53, and 54. Transfer points (primary transferring points) are denoted by T1Y, T1C, T1M, and T1K.

Each of the single-color toner image formers 40(Y) for yellow, 40(M) for magenta, 40(C) for cyan, and 40(K) for black includes a photoconductor 41 having a photosensitive layer on the outer peripheral surface thereof as an image supporting member, a charging roller 42 as a charger for uniformly charging the outer peripheral surface of the photoconductor 41, an exposing member 43 for selectively exposing the outer peripheral surface charged by the charging roller 42 to light (L) for forming an electrostatic latent image thereon, a developing roller 44 as a developer for providing toner as developing powder to the electrostatic latent image formed by the exposing member 43 for providing a visible image (toner image), and a cleaning blade 45 as a cleaning member for removing toner remaining on the surface of the photoconductor 41 after the toner image provided by the developing roller 44 is transferred to the intermediate transferring belt 30 of an intermediate transferring member (primarily transferred object).

The full-color toner image provided by primarily transferred toner images in sequence to the intermediate transferring belt 30 so as to be superposed thereon is secondarily transferred to a recording medium P such as paper at a secondary transferring point T2 and is fixed on the recording medium P as it passes through a fixing roller pair 61 of a fixing section. The recording medium P with the fixed image is then is ejected onto a paper ejection tray 68 formed on the top of the apparatus by a paper ejection roller pair 62.

In a paper feeding cassette 63, a large number of recording media P can be stacked. A pickup roller 64 feeds the recording media P one at a time from the paper feeding cassette 63. A gate roller pair 65 defines the supply timing of the recording medium P to the secondary transferring point T2. A secondary transferring roller 66 is used as a secondary transferring member for forming the secondary transferring point T2 with the intermediate transferring belt 30. A cleaning blade 67 as a cleaning member removes toner remaining on the surface of the intermediate transferring belt 30 after the secondary transfer.

As also shown in FIG. 1, the image supporting members 41 of the single-color toner image formers 40 (Y, C, M, and K) are placed in contact with the tensed side of the intermediate transferring belt 30, but may be placed in the slacked side (the drive roller 10 and the driven roller 20 may be placed in a reverse manner).

In any way, the velocity Vt (circulating velocity) of the transferring belt 30 is higher than the circumferential velocity Vd1 of each of the image supporting members 41 (Vd1, Vd2, Vd3, Vd4). That is, Vt>Vdi. The image supporting members 41 may be set to the same circumferential velocity Vdi (Vd1=Vd2=Vd3=Vd4); however, it is desirable that the circumferential velocity of an image supporting member 41 be set lower than the circumferential velocity of an adjacent image supporting member 41 based on their position from the drive roller 10. For example, Vd4>Vd3>Vd2>Vd1.

In such a configuration, the tensed state of the intermediate transferring belt 30 becomes stable not only between the drive roller 10 and the image supporting member 41(K) adjacent to the drive roller 10, but also between the respective image supporting members.

In explanation, since a circumferential velocity Vdi of the image supporting member 41 further from the drive roller 10 is set to be lower, every image supporting member positioned upstream acts reliably as a brake with respect to a downstream portion of the transferring belt 30 positioned between the adjacent image supporting members 41, so that the tensed state of the transferring belt 30 also becomes stable between the image supporting members 41.

More specifically, when the image supporting member 41 abuts the transferring belt 30 at the velocity Vdi lower than the velocity Vt of the transferring belt 30, the following friction force Ft (see FIG. 2) occurs in the abutment point therebetween. Ft is represented by the following equation:

$$Ft=\mu Q$$

where $\mu$ represents the friction coefficient between image supporting member 41 and transferring belt 30, and Q represents the abutment load acting therebetween.

The friction force Ft acts to tense a portion of the transferring belt 30 situated between a point onto which the image supporting member abuts and a point where the belt starts to be wound on the drive roller 10. Since a circumferential velocity Vdi of the image supporting member 41 further from the drive roller 10 is set to be lower, namely, Vd4>Vd3>Vd2>Vd1, as described above, a somewhat slip occurs in each transferring point (abutment point) so that the friction force (belt tension) Ft occurs in each transferring point (T1K, T1M, T1C, T1Y).

Therefore, the image supporting member 41 (K) acts as a brake with respect to the portion of the transferring belt 30 situated between a point at which the transferring belt 30 starts to be wound on the drive roller 10 and an abutment point T1K at which the image supporting member 41 (K) abuts on the transferring belt 30, so that the tensed state of that portion of the transferring belt 30 becomes stable.

Similarly, the image supporting member 41 (M) acts as a brake with respect to the portion of the transferring belt 30 situated between the abutment point T1K and an abutment point T1M at which the image supporting member 41 (M) abuts on the transferring belt 30, so that the tensed state of that portion of the transferring belt 30 becomes stable.

The image supporting member 41 (C) acts as a brake with respect to a portion of the transferring belt 30 situated between the abutment point T1M and an abutment point T1C at which the image supporting member 41 (C) abuts on the transferring belt 30, so that the tensed state of that portion of the transferring belt 30 becomes stable.

Further, the image supporting member 41 (Y) acts as a brake with respect to a portion of the transferring belt 30 situated between the abutment point T1C and an abutment point T1Y at which the image supporting member 41 (C) abuts on the transferring belt 30, so that the tensed state of that portion of the transferring belt 30 becomes stable.

Thus, the tensed state of the intermediate transferring belt 30 becomes stable not only between the drive roller 10 and the image supporting member 41 (K) adjacent to the drive roller 10, but also between the respective image supporting members, so that the transferring belt 30 is stretched between the respective transferring points.

Accordingly, the circulating state of the transferring belt 30 becomes stable without wrinkles or slack, and the transferring position is fixed uniquely to a predetermined position. That is, the state of the transferring point from each image supporting member 41 to the intermediate transferring belt 30 also becomes stable so that a good color image can be attained.

Furthermore, according to the above velocity arrangement, an initial tension given to the transferring belt 30 can be lessened because the tensed state of the transferring belt 30 becomes stable when the image forming apparatus is activated (when the image supporting members 41 and the transferring belt 30 are driven).

Therefore, when the image forming apparatus is not activated (the transferring belt 30 and the image supporting members 41 are not driven) for a long time period, a considerably large tension does not act on the transferring belt 30. Consequently, this reduces or eliminates creep deformation of the transferring belt 30 and therefore, image formation and quality can be improved.

Figure 2:
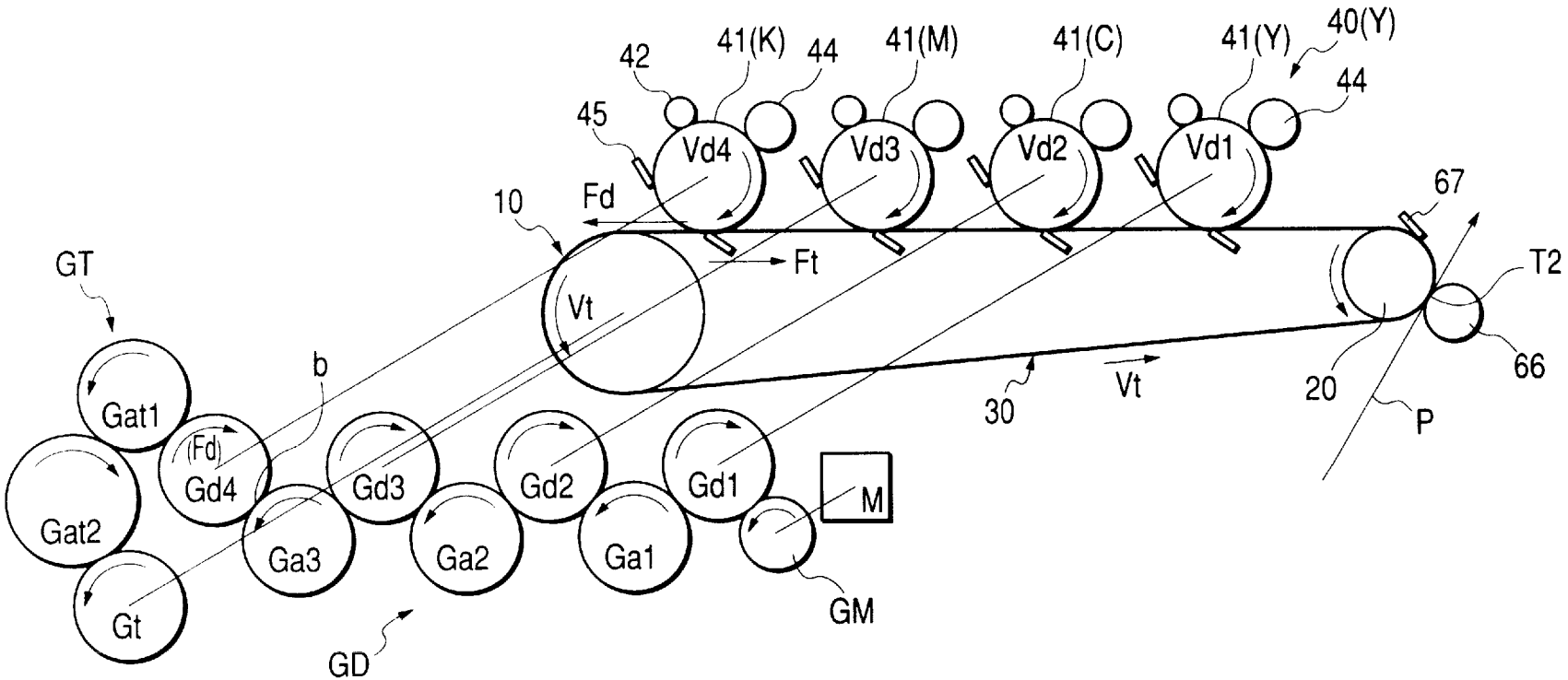
FIG. 2 is a drawing to schematically show a driving mechanism for image supporting members and a transferring member.

As shown in FIG. 2, the apparatus has a first gear train GD for driving the image supporting members 41 and a second gear train GT for driving the intermediate transferring belt 30. Both gear trains are driven by a single drive source gear GM. The second gear train GT is driven through the first gear train GD so that the gear trains started from the drive source gear GM to a drive gear Gt at the last stage is implemented as one gear train with no branch.

That is, the drive source gear GM is driven as it is fixed to an output shaft of a motor M and a gear Gd1 meshes with the drive source gear GM, whereby the image supporting member 41 (Y) is driven at the circumferential velocity Vd1. A gear Gd2 meshes with the gear Gd1 through an idle gear Ga1, whereby the image supporting member 41(C) is driven at the circumferential velocity Vd2 (>Vd1). Likewise, a gear Gd3 meshes with the gear Gd2 through an idle gear Ga2, whereby the image supporting member 41 (M) is driven at the circumferential velocity Vd3 (>Vd2). Next, a gear Gd4 meshes with the gear Gd3 through an idle gear Ga3, whereby the image supporting member 41 (K) is driven at the circumferential velocity Vd4 (>Vd3). Finally, the drive gear Gt meshes with the gear Gd4 through idle gears Gat1 and Gat2, whereby the drive roller 10 is driven at the circumferential velocity Vt (>Vd4).

Therefore, the second gear train GT (gears Gat1, Gat2, and Gt) is driven through the first gear train GD (gears Gd1, Ga1, Gd2, Ga2, Gd3, Ga3, and Gd4) and the gear train from the drive source gear GM to the drive gear Gt at the last stage is implemented as one gear train with no branch.

Figure 6:
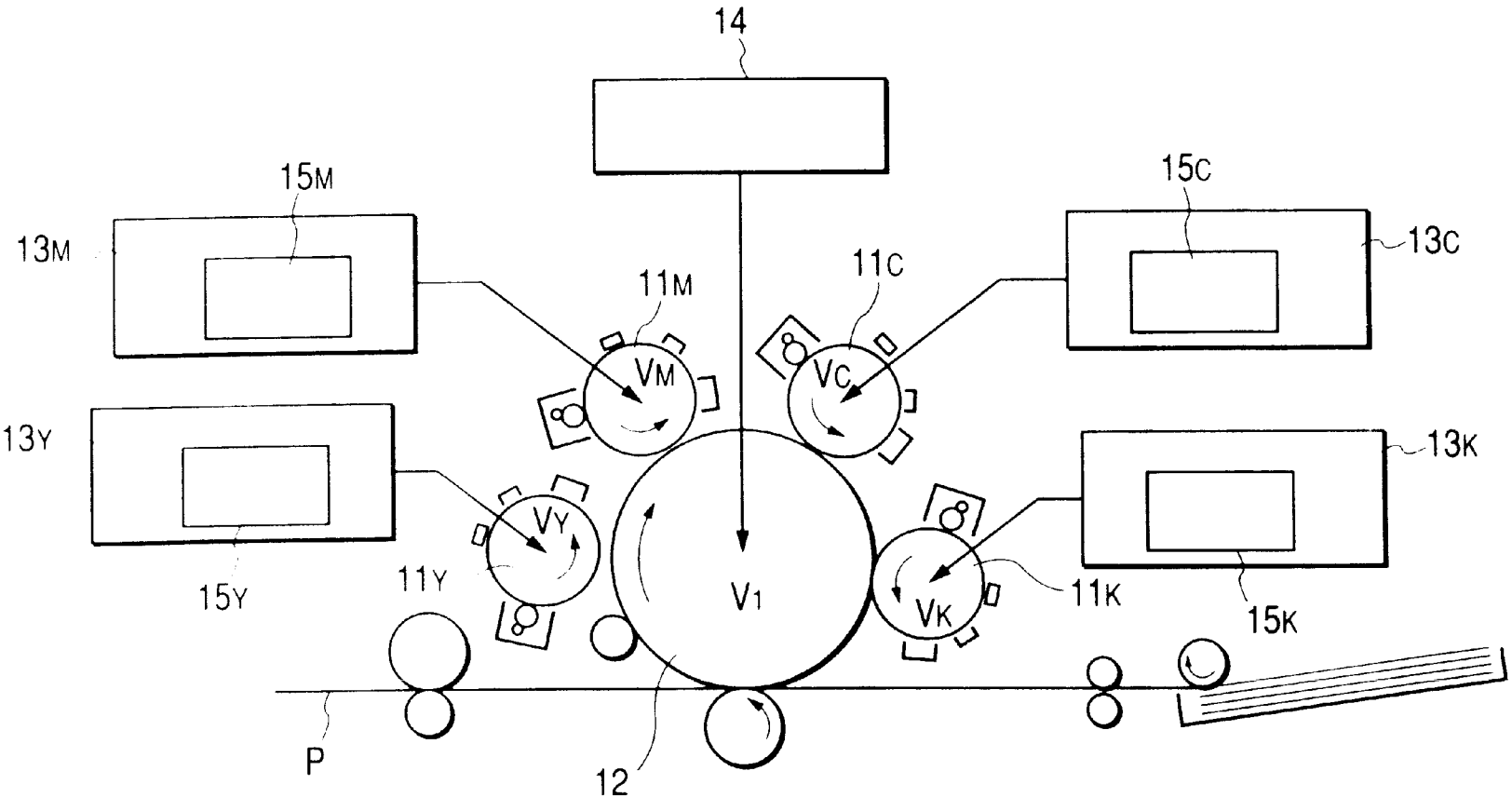
PRIOR ART FIG. 6
FIG. 6 is a schematic view showing another related art color image forming apparatus.

According to the above configuration, since both drive gear trains GD and GT are driven by the single drive source gear GM, the mechanical structure is remarkably simplified as compared with the related mechanism shown in FIG. 6. Consequently, the size of the image forming apparatus can be reduced.

Furthermore, backlash in the first gear train GD does not occur although the circumferential velocity Vt of the transferring member 30 is higher than the circumferential velocity Vdi of each of the image supporting members 41. This point is discussed in detail below.

When the image supporting member 41 abuts the transferring member 30 at the velocity Vdi lower than the velocity of the transferring member 30, the following friction force Ft ($=\mu Q$) occurs in the abutment point therebetween, so as to tense the transferring belt 30, as discussed above.

In contrast, the image supporting member 41 receives a force Fd (acceleration force attempting to rotate the image supporting member 41 at a higher rate than a predetermined number of revolutions (at equal velocity to the circulation velocity of the intermediate transferring belt 30) from the transferring belt 30 as a reaction. This also applies if the transferring member 30 is implemented as a transferring drum, or the like.

The forces Ft and Fd occur in each abutment point (T1). In the description to follow, the image supporting member 41 (K) is taken as a representative. The force Fd is transmitted to the gear Gd4 via the image supporting member 41 (K).

Figure 3:
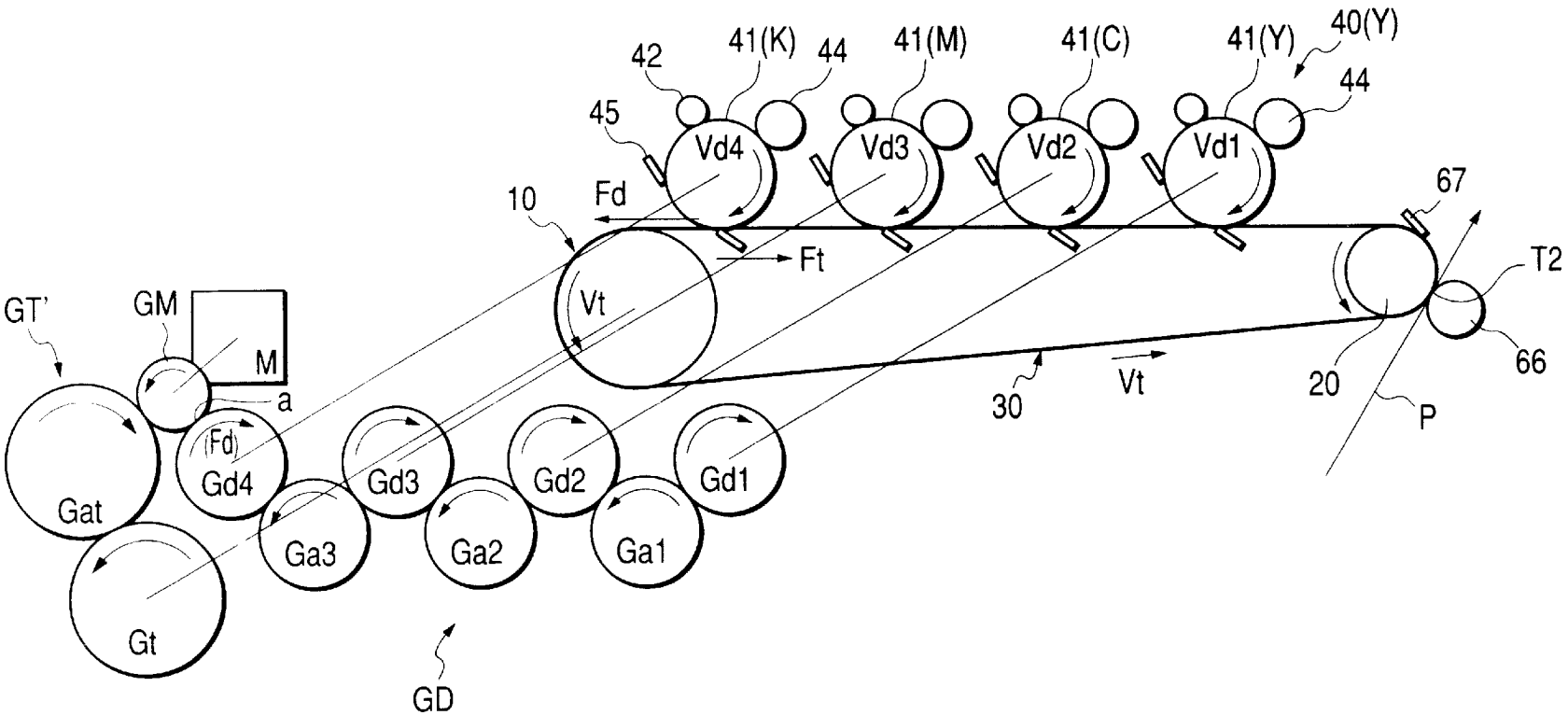
FIG. 3 is a drawing to schematically show another example of a driving mechanism for the image supporting members and the transferring member.

As an example, as shown in FIG. 3, assume that the first gear train GD is separated from a second gear train GT' and that the drive source gear GM is meshed directly with the gear Gd4 as opposed to meshing with gear Gd1 as shown in FIG. 2. In this configuration, the force Fd from the transferring belt 30 is transmitted to a mesh part a with the drive source gear GM via the gear Gd4. Since this force Fd is a force attempting to rotate the image supporting member 41 and the gear Gd4 at a higher rate than the predetermined number of revolutions (at equal velocity to the circulation velocity of the intermediate transferring belt 30), as shown in FIG. 4A, there is a probability that backlash S will occur in the mesh part a of the gears Gd4 and the drive source gear GM, placing the image supporting member 41 in an unstable rotating condition.

In contrast, according to the embodiment as shown in FIG. 2, the first gear train GT is driven through the second gear train GD so that the gear train from the drive source gear GM to the drive gear Gt at the last stage is implemented as one gear train with no branch. Thus, as shown in FIG. 4B, this arrangement makes it impossible that the force Fd acts as a force attempting to rotate the gears Gd4 and Ga3 at a higher rate than the predetermined number of revolutions (at equal velocity to the circumferential velocity of the transferring member 30). Even if backlash S is about to occur in the abutment point b between the gears Gd4 and Ga3 in such a case as shown in FIG. 4B, power transmission from the idle gear Ga3 of the drive force transmission gear to the gear Gd4 is not conducted and power transmission to the transferring member 30 (the second gear train GT at the following stage of the gear Gd4) accelerated relative to the image supporting member 41 is also not conducted.

Figure 4A:
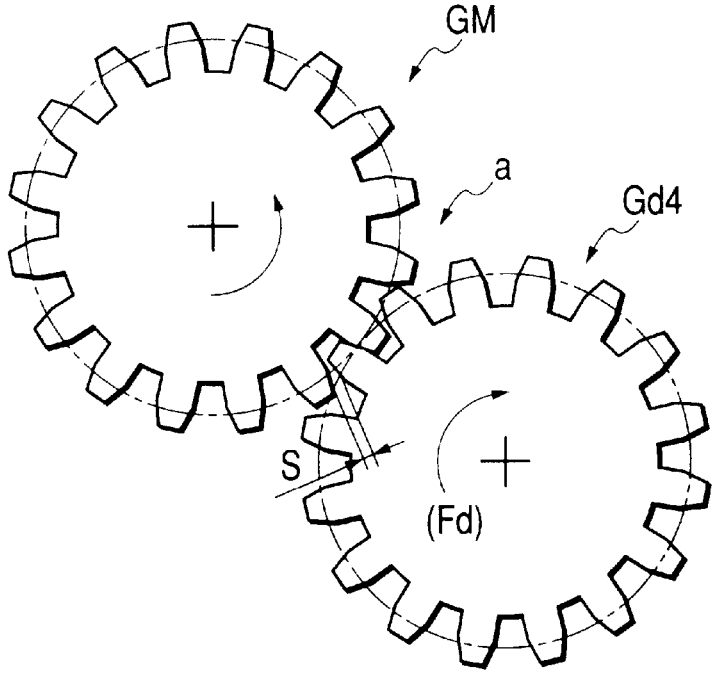
FIG. 4A is a drawing to explain a backlash occurred in the driving mechanism shown in FIG. 3.
Figure 4B:
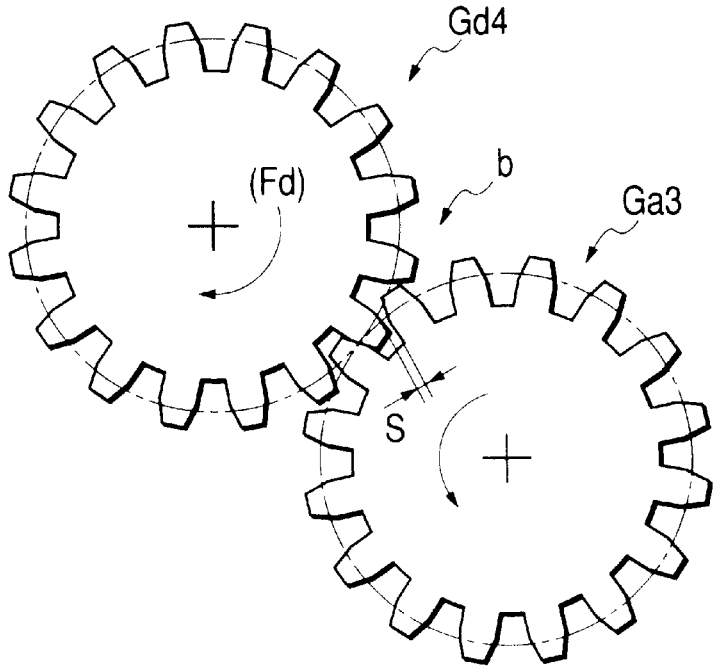
FIG. 4B is a drawing to explain a backlash occurred in the driving mechanism shown in FIG. 2.
Figure 5:
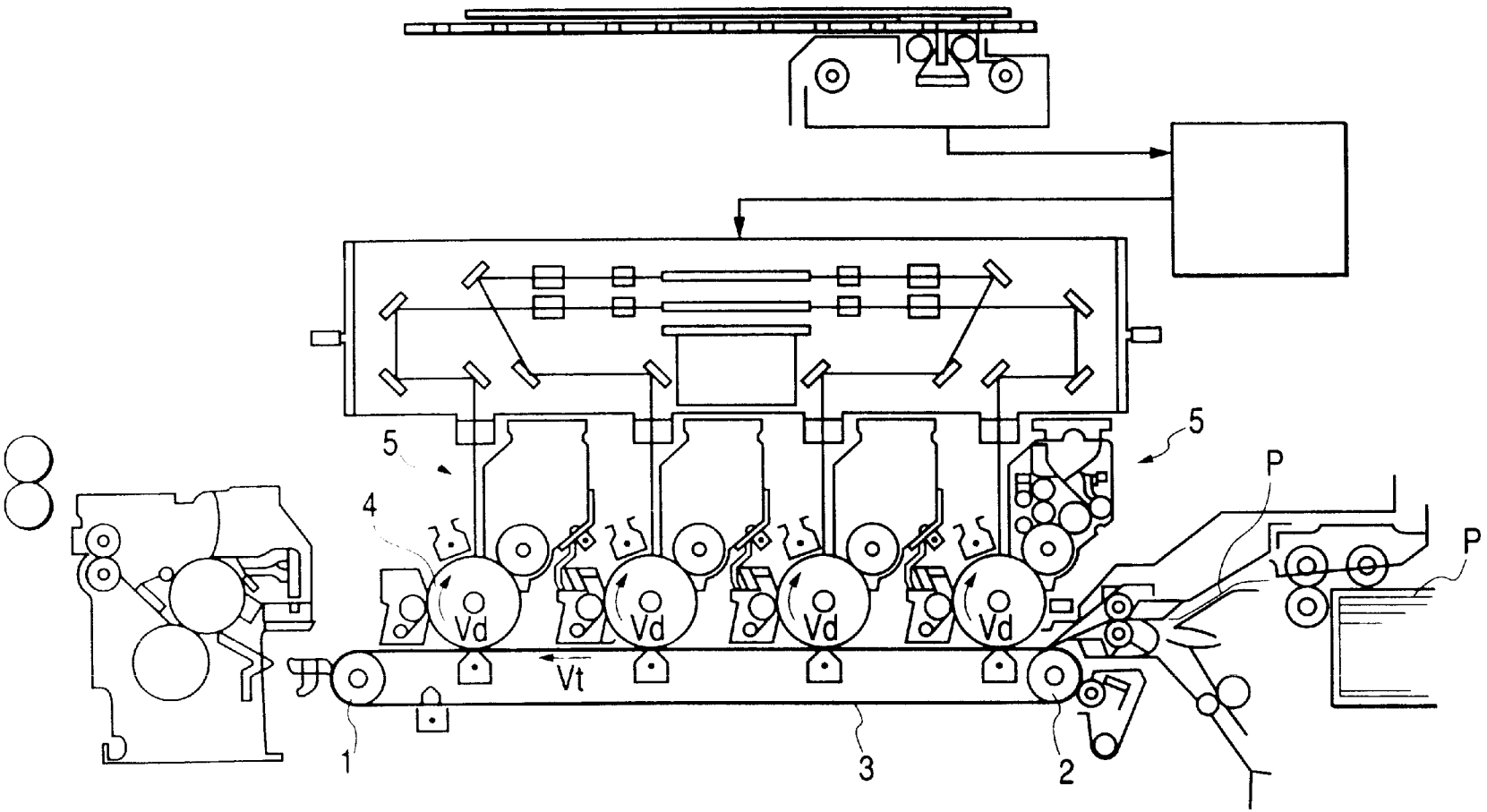
PRIOR ART FIG. 5
FIG. 5 is a schematic front view showing a related art color image forming apparatus.

That is, according to the configuration of the embodiment, it is made impossible to realize the state shown in FIG. 4A (state in which backlash S occurs). Thus, although the velocity Vt of the transferring member 30 is higher than the circumferential velocity Vdi of the image supporting member 41, the backlash in the first gear train GD cannot occur, the rotation state of the image supporting member 41 becomes stable, and consequently, good color superposing accuracy can be attained.

As such, according to the embodiment, the velocity relationship that Vt>Vdi described above can be reliably provided so that the variation in the difference between the circumferential velocity of the image supporting member 41 and the circumferential velocity of the transferring member 30 can be reliably minimized. Accordingly, the transferring condition from the image supporting member 41 to the transferring member 30 can be reliably stabilized, so that a fine image may be obtained.

Particularly in the color image forming apparatus wherein a plurality of the image supporting members are provided for supporting different-color images to be once transferred onto a transferring member in sequence to form a color image thereon, or in a color image forming apparatus wherein different-color images are directly transferred onto a recording medium held on a transferring member to form a color image thereon (not shown), not only the driving mechanism for the image supporting members and the transferring member is remarkably simplified, but also a fine color image with no color shift can be reliably obtained.

As also shown in FIG. 1, the secondary transferring point T2 for transferring a color toner image from the intermediate transferring belt 30 to the recording medium P is formed in the part of winding the intermediate transferring belt 30 around the driven roller 20, so that the recording medium P passes through the secondary transferring point T2 upward from the lower side. The driven roller 20 is rotatably supported at both ends by bearing members (not shown) such that a core shaft thereof is not displaced, to make the secondary transferring point T2 stable.

The cleaning blade 67 for removing the remaining toner on the intermediate transferring belt 30 after secondary transfer abuts the intermediate transferring belt 30 in the part of winding the intermediate transferring belt 30 around the driven roller 20.

The intermediate transferring belt 30 may have at least one of the following conditions, i) a surface hardness set greater than that of the image supporting member 41;

ii) a surface roughness set greater than that of the image supporting member 41; and iii) an abrasive, for example, high-hardness particles, alumina, or ceramic, is added to the surface. Here, the belt surface may be impregnated with the abrasive or the abrasive may be coated on the belt surface.

Generally, the remaining toner from transfer exists on the image supporting member 41 and accumulates gradually thereon, causing so-called filming to occur as one factor of degradation of the image quality.

However, according to any of the above configurations, the surface of the image supporting member 41 is slightly cut and is always refreshed because of the difference between the circumferential velocity of the transferring member 30 and the circumferential velocity of the image supporting member 41. Therefore, filming is prevented so that the image quality is maintained.

Although the present invention has been shown and described with reference to specific preferred embodiments, various changes and modifications will be apparent to those skilled in the art from the teachings herein. Such changes and modifications are deemed to come within the spirit, scope and contemplation of the invention as defined in the appended claims.

For example, an intermediate transfer drum may be used as the transferring member instead of the above-described intermediate transfer belt. Alternatively, a member (a belt member, a drum member or the like) for holding and transporting a recording medium thereon may be used as the transferring member.

In addition, while each of the transferring members 51, 52, 53, and 54 in the above embodiment is implemented as a transfer blade, the transferring members may also be implemented, for example, as a corona transfer device.

Further, of course, the drive roller 10 may be implemented as a tension roller and/or meander regulation roller.

What is claimed is:

1. A color image forming apparatus, comprising:

a drive roller and a driven roller;

a looped belt member stretched and circulated by at least the drive roller and the driven roller;

a plurality of image supporting members, each supporting a single color toner image thereon, and abutting onto a tensed side of the belt member to define a transferring position at which the toner image is transferred onto either the belt member or a recording medium held by the belt member, while being rotated;

a first gear train, which rotates the image supporting members;

a second gear train, which rotates the drive roller to circulate the belt member, while being connected to the first gear train with no branch; and a single drive source, which drives the first gear train to thereby drive the second gear train, wherein:

a circumferential velocity of each image supporting member is determined so as to be lower than a circulation velocity of the belt member; and the circumferential velocity of an image supporting member which is further from the drive roller is lower than the circumferential velocity of an image supporting member which is closer to the drive roller.

2. The color image forming apparatus as set forth in claim 1, wherein a surface hardness of the belt member is greater than a surface hardness of the image supporting members.

3. The color image forming apparatus as set forth in claim 1, wherein the belt member includes an abrasive surface.

4. The color image forming apparatus as set forth in claim 1, further comprising a cleaning member which abuts against a part of the belt member which is wound on the driven roller, to remove toner remained on the belt member.

5. The color image forming apparatus as set forth in claim 1, further comprising a secondary transfer position, formed on a part of the belt member which is wound on the driven roller, at which the toner images transferred from the image supporting members are secondarily transferred to a recording medium, wherein the recording medium passes through the secondary transfer position upward from a lower part of the apparatus.

6. The image forming apparatus as set forth in claim 5, further comprising a fixing section at which the secondarily transferred toner image is fixed on the recording medium, wherein the fixing section is placed above the plurality of image supporting members.

7. The color image forming apparatus as set forth in claim 1, wherein the belt member is stretched and circulated so as to have a tensed side and a slack side.

8. A color image forming apparatus, comprising:

a drive roller and a driven roller;

a looped belt member stretched and circulated by at least the drive roller and the driven roller; and a plurality of image supporting members, each supporting a single color toner image thereon, and abutting onto a tensed side of the belt member to define a transferring position at which the toner image is transferred onto either the belt member or a recording medium held by the belt member, while being rotated, wherein:

a circumferential velocity of each image supporting member is determined so as to be lower than a circulation velocity of the belt member;

the circumferential velocity of an image supporting member which is further from the drive roller is lower than the circumferential velocity of an image supporting member which is closer to the drive roller; and a surface roughness of the belt member is greater than a surface roughness of the image supporting members.

9. The color image forming apparatus as set forth in claim 8, wherein a surface hardness of the belt member is greater than a surface hardness of the image supporting members.

10. The color image forming apparatus as set forth in claim 8, wherein the belt member includes an abrasive surface.

11. The color image forming apparatus as set forth in claim 8, further comprising a cleaning member which abuts against a part of the belt member which is wound on the driven roller, to remove toner remained on the belt member.

12. The color image forming apparatus as set forth in claim 8, further comprising a secondary transfer position, formed on a part of the belt member which is wound on the driven roller, at which the toner images transferred from the image supporting members are secondarily transferred to a recording medium, wherein the recording medium passes through the secondary transfer position upward from a lower part of the apparatus.

13. The image forming apparatus as set forth in claim 12, further comprising a fixing section at which the secondarily transferred toner image is fixed on the recording medium, wherein the fixing section is placed above the plurality of image supporting members.

14. The color image forming apparatus as set forth in claim 8, wherein the belt member is stretched and circulated so as to have a tensed side and a slack side.

15. A color image forming apparatus, comprising:

a transferring member;

a plurality of image supporting members, each supporting a single color toner image thereon, and abutting onto the transferring member to define a transferring position at which the toner image is transferred onto either the transferring member or a recording medium held by the transferring member, while being rotated;

a first gear train, which rotates the image supporting members;

a second gear train, which rotates the transferring member, while being connected to the first gear train with no branch; and a single drive source, which drives the first gear train to thereby drive the second gear train, wherein a circumferential velocity of each image supporting member is determined so as to be lower than a circulation velocity of the transferring member.

16. The color image forming apparatus as set forth in claim 15, wherein a surface hardness of the transferring member is greater than a surface hardness of the image supporting members.

17. The color image forming apparatus as set forth in claim 15, wherein a surface roughness of the transferring member is greater than a surface roughness of the image supporting members.

18. The color image forming apparatus as set forth in claim 15, wherein the transferring member includes an abrasive surface.

* * * * *